US007802700B2

(12) United States Patent
Ardern et al.

(10) Patent No.: US 7,802,700 B2
(45) Date of Patent: Sep. 28, 2010

(54) PRODUCT DISCHARGE AND DELIVERY SYSTEM FOR A VENDING MACHINE

(75) Inventors: John P. Ardern, Clermont, FL (US); Dan Bowen, Aiken, SC (US); Paul Miller, Aiken, SC (US); Charles Wayne Percy, Aiken, SC (US); Kevin A. Poyck, Lexington, SC (US); Denise Schmidt, Windsor, SC (US)

(73) Assignee: Crane Merchandising Systems, Inc., Bridgeton, MI (US)

( * ) Notice: Subject to any disclaimer, the term of this patent is extended or adjusted under 35 U.S.C. 154(b) by 1125 days.

(21) Appl. No.: 11/249,527

(22) Filed: Oct. 14, 2005

(65) Prior Publication Data

US 2007/0084876 A1 Apr. 19, 2007

(51) Int. Cl.
*G07F 11/16* (2006.01)

(52) U.S. Cl. ..... 221/258; 221/224; 221/225; 221/236; 221/123; 221/124; 221/129; 221/195; 221/196

(58) Field of Classification Search ..... 221/1–312 C
See application file for complete search history.

(56) References Cited

U.S. PATENT DOCUMENTS

| | | | | |
|---|---|---|---|---|
| 2,735,578 | A | 2/1956 | Woodruff | |
| 3,243,034 | A * | 3/1966 | Mueller et al. | 312/97 |
| 5,505,332 | A | 4/1996 | Vogelpohl et al. | |
| 5,651,476 | A | 7/1997 | Percy et al. | |
| 5,927,539 | A | 7/1999 | Truitt et al. | |
| 6,199,720 | B1 * | 3/2001 | Rudick et al. | 221/6 |
| 6,354,098 | B1 | 3/2002 | Bardin et al. | |
| 6,415,953 | B1 | 7/2002 | O'Brien et al. | |
| 6,499,627 | B2 | 12/2002 | Arai | |
| 6,513,677 | B1 * | 2/2003 | Sorensen et al. | 221/130 |
| 6,550,269 | B2 | 4/2003 | Rudick | |
| 6,556,889 | B2 | 4/2003 | Rudick et al. | |
| 6,564,964 | B2 | 5/2003 | Johnson | |
| 6,962,267 | B2 * | 11/2005 | Herzog et al. | 221/85 |
| 7,055,716 | B2 * | 6/2006 | Holdway et al. | 221/131 |
| 7,451,891 | B2 * | 11/2008 | Carter et al. | 221/210 |
| 2001/0000610 | A1 | 5/2001 | Johnson | |
| 2005/0082309 | A1 | 4/2005 | Holdway et al. | |
| 2005/0189370 | A1 * | 9/2005 | Carter et al. | 221/123 |

FOREIGN PATENT DOCUMENTS

| | | |
|---|---|---|
| JP | 411213225 | 8/1999 |
| JP | 2000123243 A | 4/2000 |

* cited by examiner

*Primary Examiner*—Gene Crawford
*Assistant Examiner*—Michael K Collins

(57) ABSTRACT

A product discharge and delivery system for a vending machine includes a product delivery cup including a carriage portion and a shroud portion having an open bottom section and a discharge element. After receiving a selected product, the product delivery cup is shifted toward a dispensing chamber causing the discharge element to engage with a discharge member mounted within the vending machine. Engagement of the discharge element and discharge member causes the shroud portion to pivot relative to the carrier portion exposing the open bottom section allowing a selected product to release into a dispensing chamber. A delivery port is mounted in the dispensing chamber that rotated between a product receiving position and a product delivery position.

20 Claims, 7 Drawing Sheets

PRODUCT DISCHARGE AND DELIVERY SYSTEM FOR A VENDING MACHINE

BACKGROUND OF THE INVENTION

1. Field of the Invention

The present invention pertains to the art of vending machines and, more particularly, to a product discharge and delivery system that releases a selected product towards a dispensing chamber for delivery to a consumer.

2. Discussion of the Prior Art

Vending machines for dispensing canned and/or bottled beverages have long been known. Early model vending machines release similarly sized bottles, one at a time, following deposit of the required purchase amount. In order to withdraw the selected product from the vending machine, the purchaser was required to, for example, manually remove a beverage container through a release mechanism on a shelf. Over time, manufacturers developed various mechanisms for releasing products from vending machines. The arrangements range from a more conventional mechanism wherein the products are guided to a chute, often times along a serpentine path, into a delivery port, to more unique mechanisms that shift a transport carrier to a point adjacent a selected product, receive the selected product and then deliver the selected product to the consumer.

Once at a dispensing chamber, the product must be discharged from the transport system. Various mechanisms have been employed to discharge the selected product from the transport system into the dispensing chamber. In one example, the product is simply run along the conveyor belt into a dispensing area. In another example, the selected product is ejected from a shifting carriage and allowed to fall into the dispensing chamber. More specifically, once at the dispensing chamber, a motor is activated to operate cams and/or linkages to eject the product from the carriage.

In order to retrieve the selected product, the consumer must access the dispensing chamber. Typically, this is accomplished through a door. Generally, the door is hinged at an upper portion and coupled to an anti-pilfer device. As the door is opened, a mechanism, interconnecting the door and the anti-pilfer device, causes the anti-pilfer device to close off access to product shelves. The mechanism moves the anti-pilfer device quickly so that opening the product delivery door will begin to shift a plate or door to completely cut-off access to additional stored products. However, in many cases, opening the product delivery door slightly will provide enough room for a tool to be inserted up into the storage/display section. Particularly in the area of beverage vending machines, it is becoming increasingly difficult to provide a dispensing chamber large enough to accommodate the increased size of product containers while, at the same time, providing an anti-pilfer mechanism that completely prevents access to stored products.

Despite the various mechanisms employed in the prior art to transport a selected product from. a display portion to a delivery portion of a vending machine and discharge the product to a consumer, there still exists a need for an enhanced product discharge and delivery mechanism for a vending machine. More specifically, there exists a need for a discharge and delivery system that is not only simple to operate and easy to maintain, but also incorporates an effective anti-pilfer device for the vending machine.

SUMMARY OF THE INVENTION

The present invention is directed to product discharge and delivery system for a vending machine having a storage zone within which is arranged at least one shelf having a pair of dividers that establish a product queue. In accordance with the invention, the vending machine includes a product transport system for carrying a selected product from the product queue to a dispensing chamber that is provided with a delivery port.

In further accordance with the invention, a product delivery cup is mounted for movement with the product transport system. The product delivery cup includes a carriage portion and a shroud portion pivotally mounted to the carriage portion. In addition, the shroud portion includes a discharge element. Preferably, the discharge element constitutes a rib that extends laterally outwardly from the shroud portion.

In still further accordance with the invention, the shroud portion includes an open bottom section that is selectively exposed to released the selected product. More specifically, upon selecting a product, the product delivery cup is shifted from the home position to the receiving position adjacent the product queue. At this point, the selected product is shifted into the product delivery cup. Once the product is received, the product delivery cup is shifted towards a delivery position. As the product delivery cup approached the delivery position, the discharge element engages a discharge member provided in the storage zone causing the shroud to pivot relative to the carriage. Continued movement of the product delivery cup exposes the open bottom section of the shroud portion and allows the selected product to fall into the dispensing chamber.

In accordance with the most preferred form of the invention, the discharge member is mounted to a door that is pivotally mounted in the cabinet. The door selectively covers a portal interconnecting the product storage zone with the dispensing chamber. Thus, engagement of the discharge element and the discharge member causes the door to pivot, thereby releasing the selected product from the product delivery cup through the portal into the dispensing chamber. Preferably, the selected product enters into a product holder positioned in the dispensing chamber.

The product holder preferably includes a shield portion and a product access opening that is rotatably mounted in the dispensing chamber. Once the selected product passes through the portal into the dispensing chamber, the product holder is selectively rotated from a product receiving position, wherein the product access opening is exposed to the portal for receiving the selected product and the shield blocks the product delivery port, to a product delivery position, wherein the shield blocks the portal and the product access opening aligns with the product delivery port to allow a consumer to retrieve the selected product.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
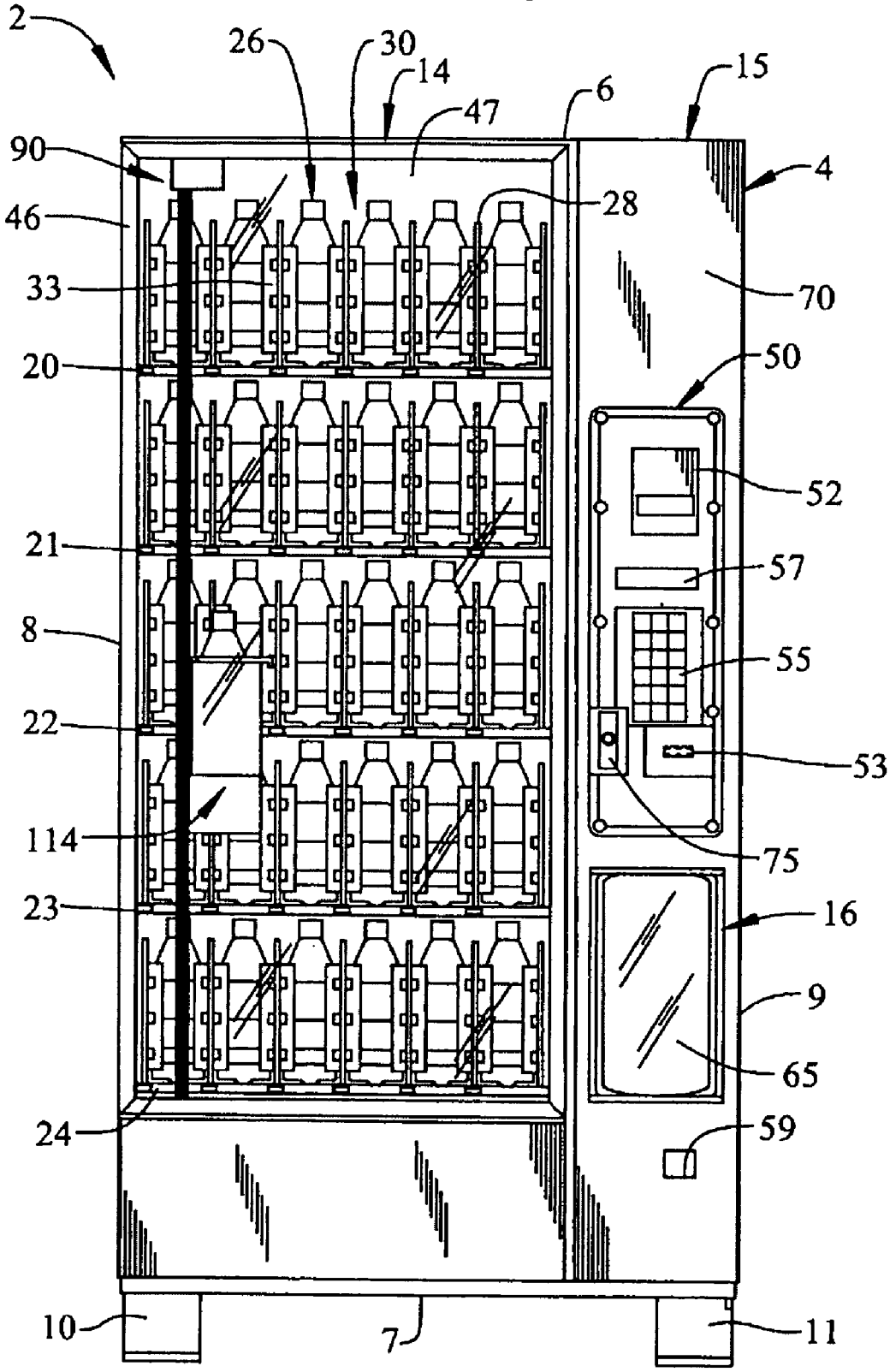
FIG. 1 is a front elevational view of a vending machine constructed in accordance with the present invention.
Figure 2:
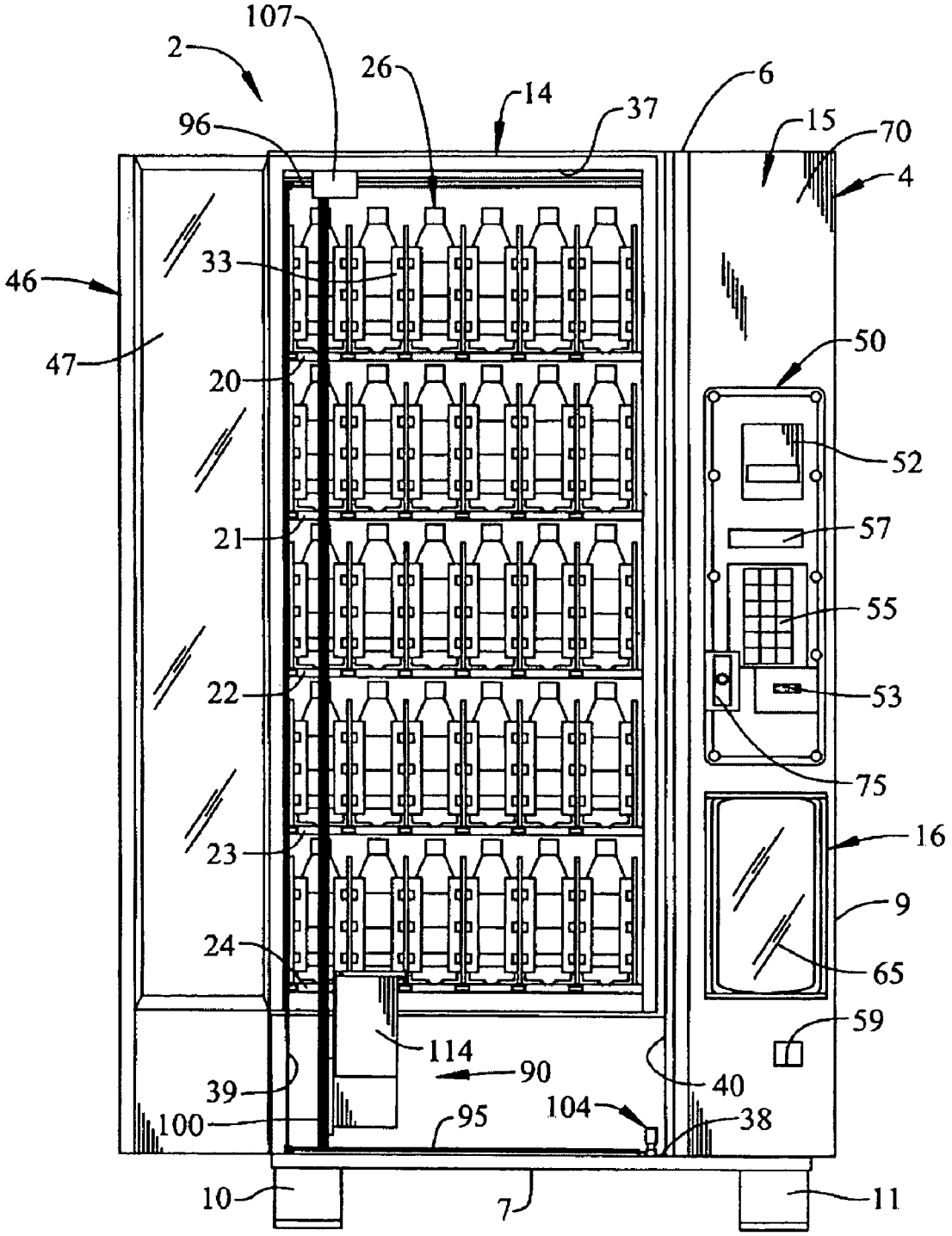
FIG. 2 is an elevational view of the vending machine of FIG. 1 with the door of a product storage zone shown open.

With initial reference to FIGS. 1 and 2, a vending machine generally indicated at 2 includes a cabinet 4. As shown, cabinet 4 includes top, bottom and opposing side walls 6-9. Arranged below bottom wall 7 are various leg members 10 and 11 for positioning vending machine 2 upon a supporting surface (not shown). In the preferred embodiment shown, vending machine 2 is divided into a plurality of zones, with each zone being associated with a particular portion of a vending operation. Towards that end, vending machine 2 includes a storage and display zone 14, a currency receiving zone 15 and a dispensing zone 16.

As illustrated, storage/display zone 14 is provided with a plurality of product support shelves 20-24 for supporting and displaying a plurality of product containers, one of which is indicated at 26. Each of the plurality of product support shelves 20-24 includes a plurality of dividers, one of which is indicated at 28, that establish a plurality of product queues, one of which is indicated at 30 on product support shelf 20. Each of the plurality of product queues 30 includes an associated dispensing or escapement mechanism 33 for releasing a product container 26 from storage/display zone 14 for delivery to a consumer. The actual construction and operation of dispensing mechanism 33 does not constitute part of the present invention. Instead, various known dispensing mechanisms could be employed, including that set forth in detail in commonly assigned U.S. Pat. No. 6,571,988 entitled "Article Release Mechanism For a Vending Machine" issued on Jun. 3, 2003. In a manner known in the art, storage/display zone 14 includes top, bottom and opposing side walls 37-40 (see FIG. 2) and is provided with a door 46 having a glass panel 47 to enable a consumer to view and choose between the variety of product containers 26 carried within vending machine 2.

Arranged alongside storage/display zone 14 is currency receiving zone 15. In the embodiment shown, currency receiving zone 15 includes a currency receiving center 50 for inputting currency deposited by the consumer during a vend transaction. Currency receiving center 50 includes a bill acceptor/validator 52, a multi-price coin mechanism 53 and a key pad 55 for inputting particular product selections. Currency receiving center 50 also includes a display 57 for providing information to the consumer, as well as validating the particular selection made. Finally, a coin return slot 59 is provided for returning any required change to the consumer at the completion of a vend operation. Arranged below currency receiving zone 15, dispensing zone 16 includes a dispensing chamber 65 that enables a consumer to remove a dispensed product from vending machine 2. In the embodiment shown, currency receiving zone 15 and dispensing zone 16 are provided on a door 70 that overlaps door 46 and therefore must be opened prior to opening door 46. To this end, door 70 is preferably provided with a lock 75 that prevents unauthorized access to within vending machine 2.

In accordance with one embodiment, vending machine 2 includes a product transport and delivery system 90 that receives one of the plurality of product containers 26 from one of the plurality of product queues 30 and transports the selected product towards delivery chamber 65 for receipt by the consumer. As referenced in FIG. 2, product transport system 90 includes a first, laterally extending guide rail 95 arranged on lower wall 38 of product storage zone 14, a second, laterally extending guide rail 96 arranged on upper wall 37 and an upstanding carriage rail 100 that extends across storage/delivery zone 14 between first and second guide rails 95 and 96. Product transport system 90 also includes a first or horizontal axis translation mechanism 104 for shifting carriage rail 100 between the plurality of product queues 30 and a second or vertical axis translation mechanism 107 that selectively shifts a product delivery cup 114, that is slidably supported by carriage rail 100, between the plurality of product shelves 20-24. In any case, product transport system 90 shifts product delivery cup 114 along multiple axes to receive and transport a selected product container 26 from one of the plurality of product queues 30 towards dispensing chamber 65 in a manner that will be detailed more fully below.

Figure 3:
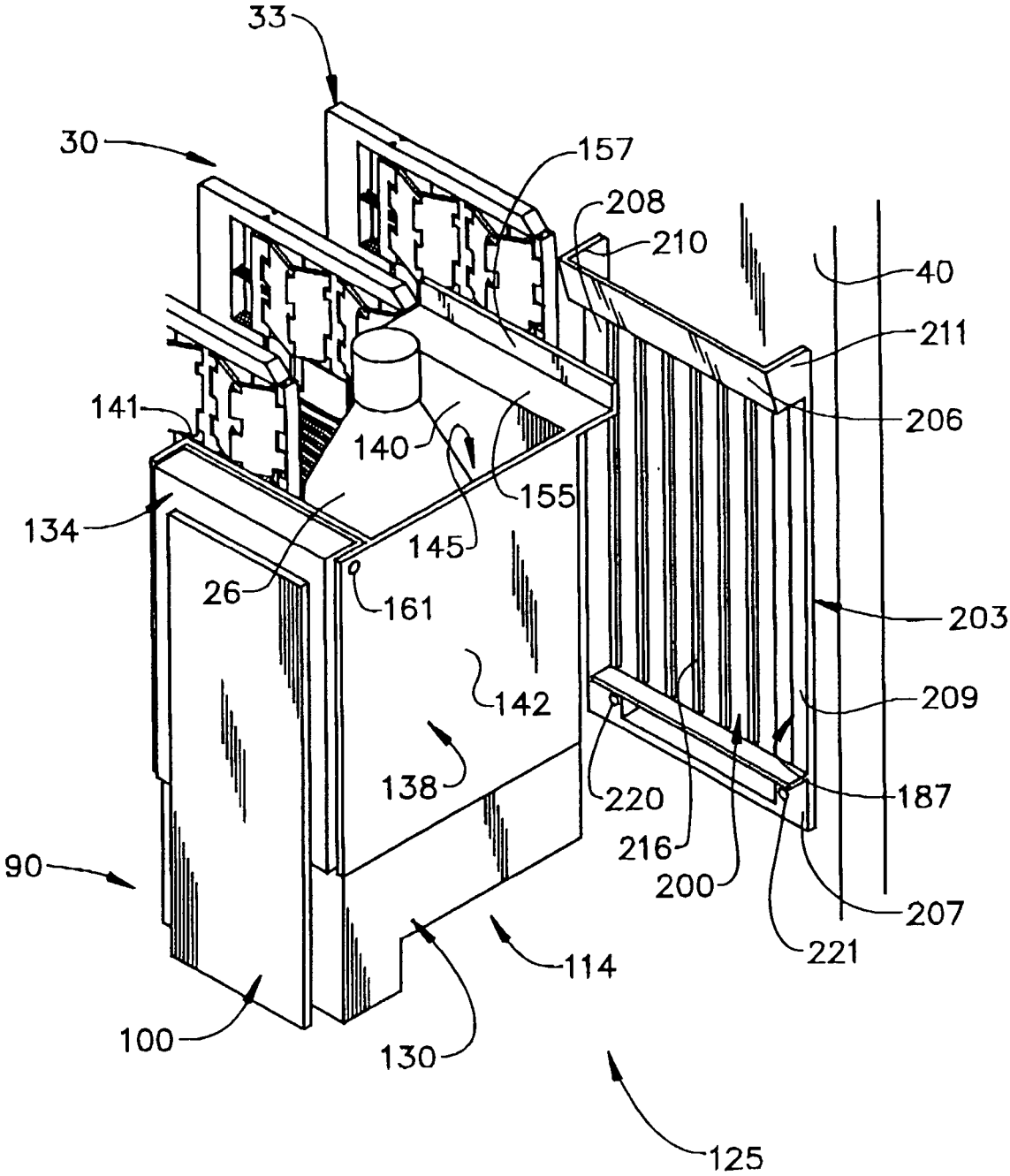
FIG. 3 is a perspective view of a delivery portion of a product discharge and delivery system constructed in accordance with the present invention, illustrating a product delivery cup moving towards a door extending across a portal interconnecting a product storage zone with a dispensing chamber.
Figure 4:
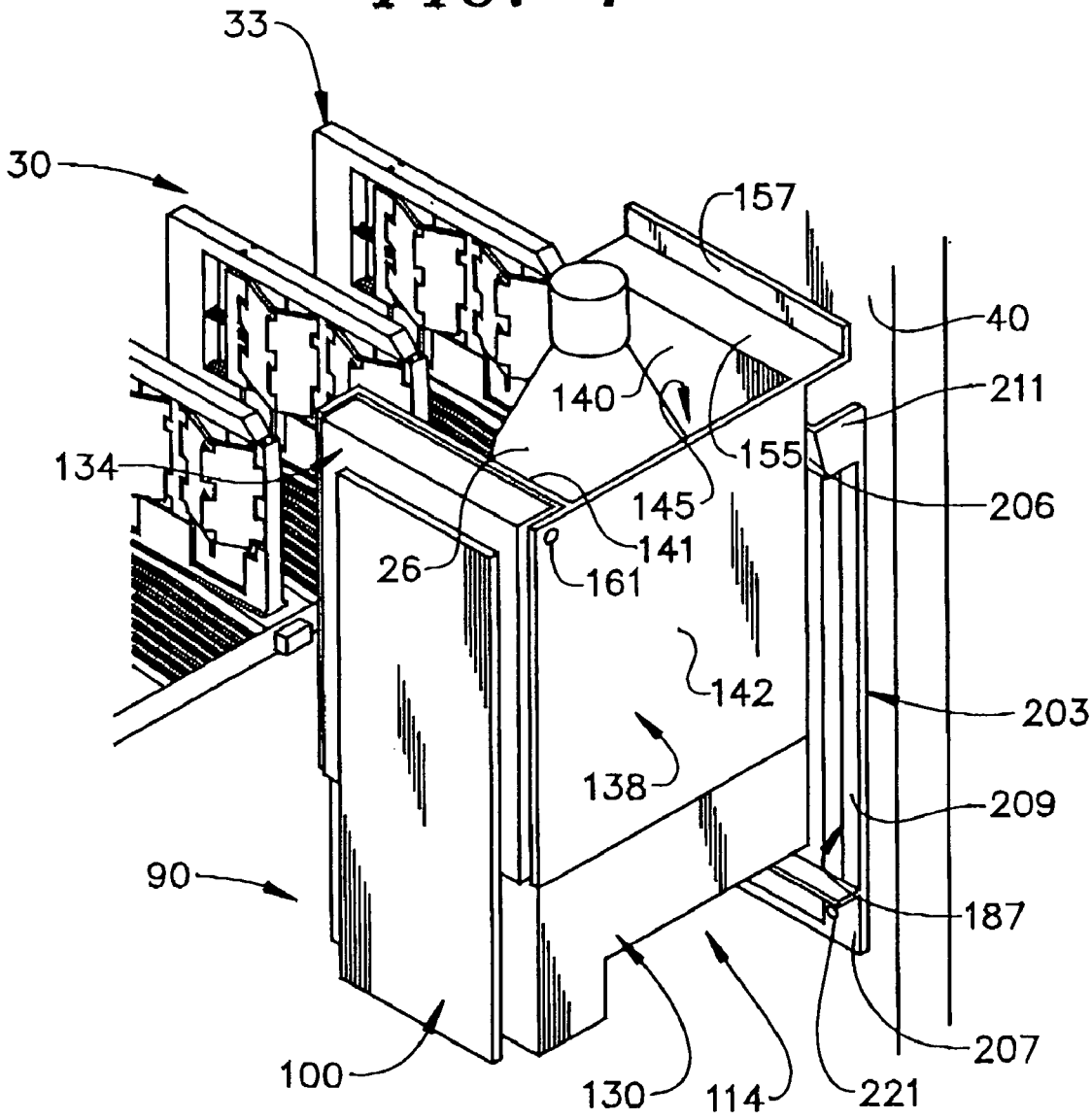
FIG. 4 is a perspective view of the delivery portion of the product discharge and delivery system of FIG. 3 illustrating a discharge element on the product delivery cup aligning with a discharge member mounted in the vending machine.
Figure 5:
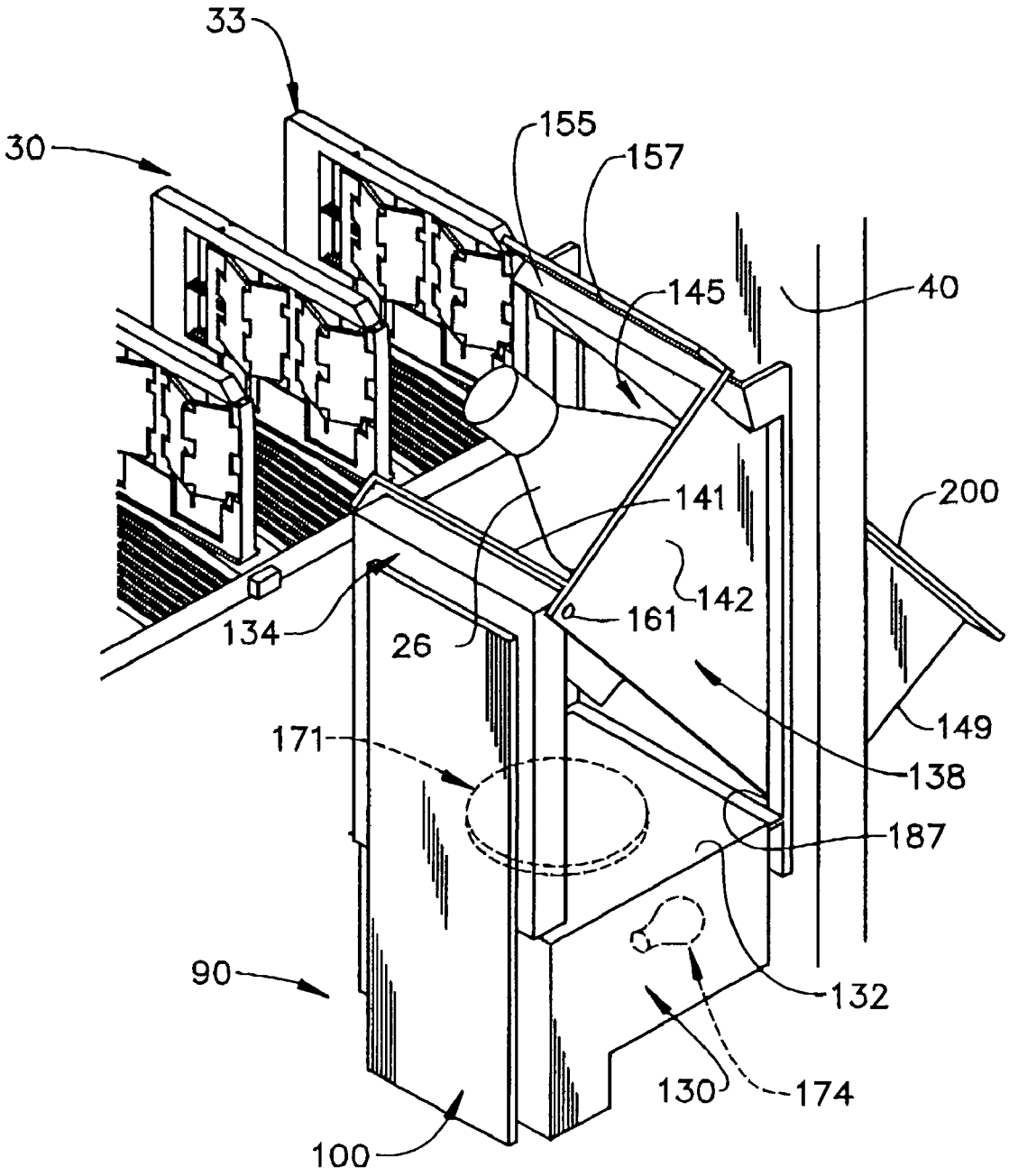
FIG. 5 is a perspective view of the delivery portion of the product discharge and delivery system of FIG. 3 illustrating the discharge element engaging with the discharge member causing a portion of the delivery cup to pivot through the portal, thereby opening the door and releasing the product into the dispensing chamber.

Reference will now be made to FIGS. 3 through 5 in describing a discharge portion 125 of an overall product discharge and delivery system of the present invention. As shown, product delivery cup 114 includes a base portion 130 having a product support surface 132, a carriage portion 134 that is shiftably mounted to carriage rail 100, and a shroud portion 138 pivotally mounted to carriage portion 134. Shroud portion 138 includes side walls 140 and 141 and a front wall 142 that collectively define a product receiving cavity 145. It should be noted that shroud portion 138 also includes a rear wall (not shown) that is lower than front wall 142, with this arrangement enabling a product container 26 to be transferred into product delivery cup 114. In any case, shroud portion 138 includes an open bottom section 149 which, as will be discussed more fully below, allows product container 26 to pass from product delivery cup 114 into dispensing zone 16. Shroud portion 138 also includes a laterally outwardly projecting extension or discharge element 155 having an up-turned portion 157 provided at an upper portion (not separately labeled) of side wall 140. As will be discussed more fully below, shroud portion 138 pivots about an axis defined by a pin 161 that pivotally secures shroud portion 138 to carriage portion 134.

In accordance with the invention, upon selecting a particular product container 26, product transport system 90 shifts product delivery cup 114 to a position adjacent a particular one of product queues 30 within which resides the selected product container 26. At this point, the dispensing unit 33 in the selected queue 30 is activated, releasing the selected product container 26 into product receiving cavity 145. Once the selected product container 26 has been received in product delivery cup 114 and rests upon product support surface 132, a sensor 171 signals product transport system 90 to shift product delivery cup 114 towards dispensing zone 16. In addition, sensor 171 preferably activates a light 174 provided in base portion 130. Most preferably, light 174 is only illuminated when a product container 26 is present within product receiving cavity 145. In any case, once the presence of product container 26 is sensed in product receiving cavity 145, product transport and delivery system 90 shifts product delivery cup 114 towards a portal 187 which is formed in side wall 40 of product storage and display zone 14 and exposed to dispensing chamber 65.

In accordance with the invention, portal 187 is provided with a door 200 pivotally attached to an outer frame 203. Outer frame 203 includes top, bottom and opposing side frame members 206-209 that extend about an outer periphery of portal 187. Top frame member 206 includes a pair of offset sections 210 and 211 that space top frame member 206 from side wall 40 such that top frame member 206 actually constitutes a discharge member as will be discussed more fully below. As best shown in FIG. 3, a plurality of reinforcing members or raised portions, one of which is indicated at 216, extend longitudinally along an outer surface (not separately labeled) of door 200. Door 200 is selectively shiftable between a closed position as illustrated in FIG. 3, to an open position, as represented in FIG. 5, allowing passage of the selected product container 26 into dispensing chamber 65. When in the closed position, a pair of magnets 220 and 221 provided in a bottom portion of frame member 207 cooperate with metallic structure (not shown) on door 200, which is preferably formed of plastic, to retain door 200 in the closed position.

Having described the particular structure of discharge mechanism 125, a description of a preferred method of operation will now follow, referring again to FIGS. 3-5. As described above, once the selected product container 26 is positioned within product receiving cavity 145 and sensed by sensor 171, product transport system 90 shifts product delivery cup 114 towards portal 187 as represented in FIG. 3. Prior to releasing the selected product container 26, product delivery cup 114 is actually positioned adjacent to, and slightly above portal 187 as shown in FIG. 4. Once product delivery cup 114 is in position, carriage portion 134 is shifted downward, causing discharge element 155 to engage with discharge member 206. Continued downward movement of product delivery cup 114 causes shroud portion 138 to pivot about the axis defined by pin 161. As shroud portion 138 pivots, side wall 140 abuts door 200, causing door 200 to also pivot such that shroud portion 138 actually passes into portal 187. Once open bottom section 149 has substantially cleared lower frame member 207, the selected product container 26 passes from shroud portion 138 into dispensing chamber 65 for delivery to a consumer in a manner that will be discussed more fully below. Upon sensing that the selected product container 26 has passed from product receiving cavity 145, sensor 171 signals product transport system 90 to return to a ready or home position as depicted in FIG. 2.

Figure 6:
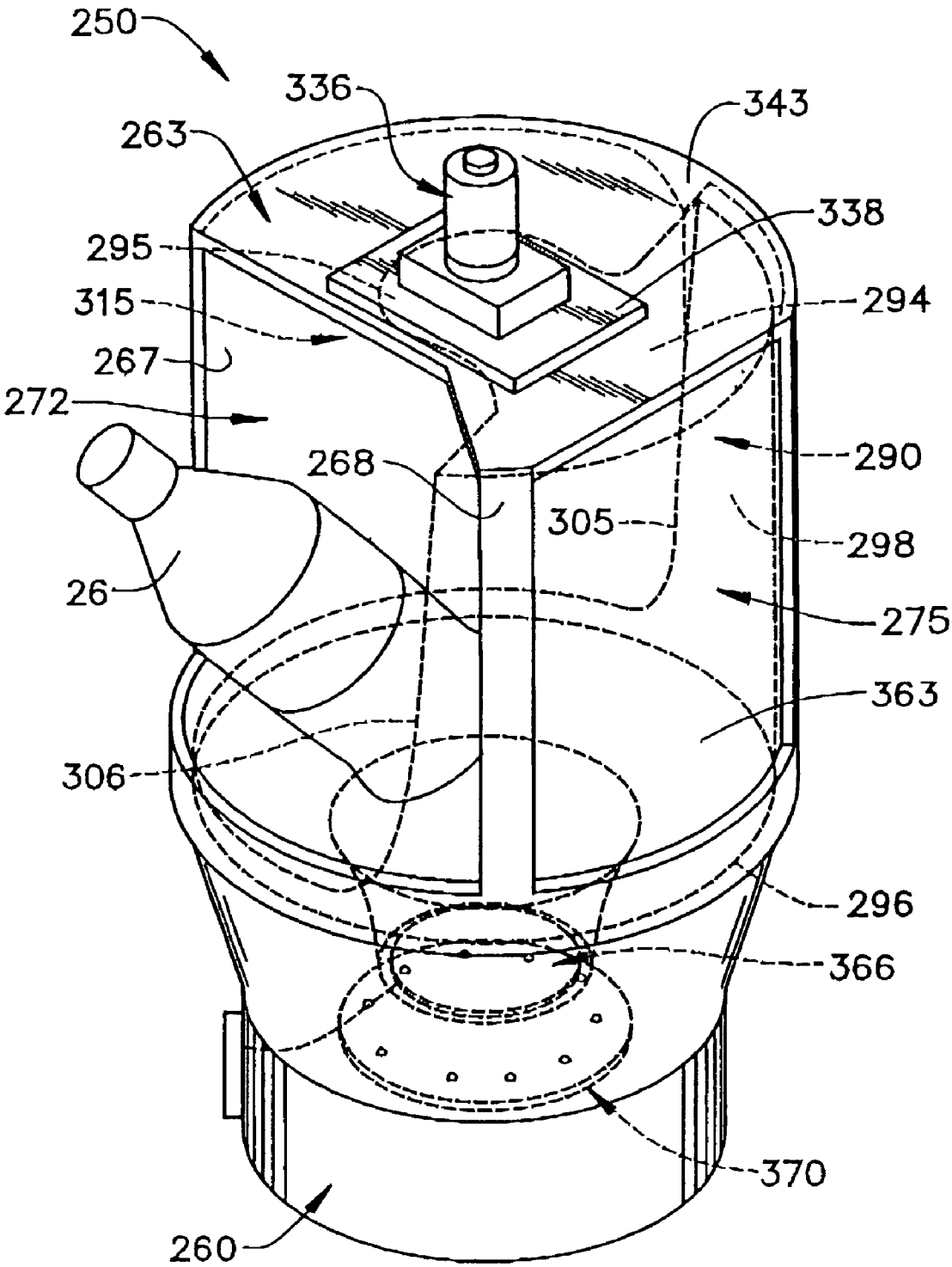
FIG. 6 is a perspective view of a discharge portion of the product discharge and delivery system constructed in accordance with the present invention, illustrating a product holder having a shield member rotated to a product receiving position.
Figure 7:
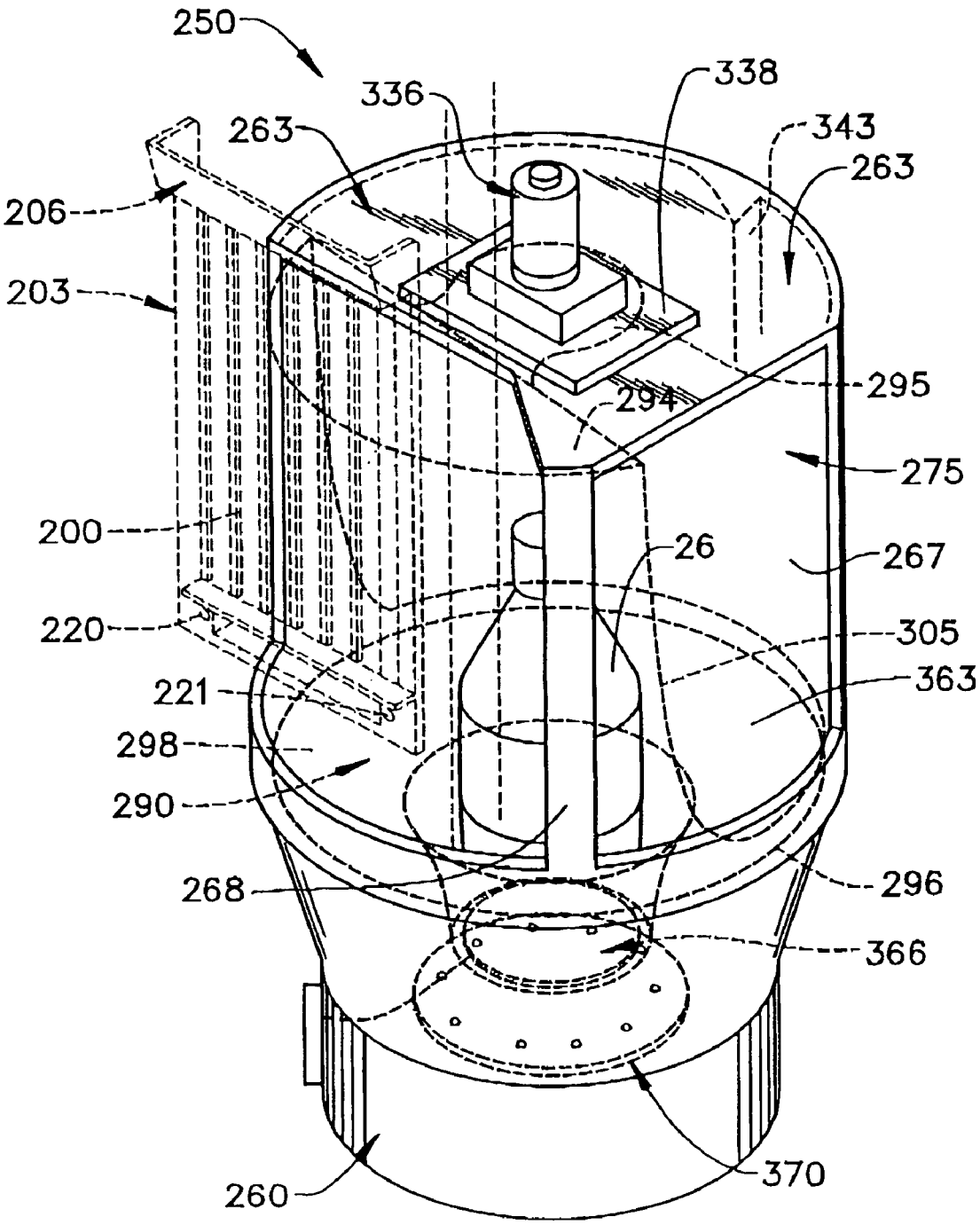
FIG. 7 shows the product holder of FIG. 6 with the shield member in a product delivery position.

After passing through portal 187, the selected product container 26 is received by a delivery or product holder 250 mounted within dispensing chamber 65. In accordance with a preferred form of the invention as depicted in FIGS. 6 and 7, product holder 250 includes a base section 260 and a top section 263 that are interconnected through first and second wall portions 267 and 268. Actually, first and second wall portions 267 and 268 are spaced one from the other so as to establish a product receiving opening 272 and a product access opening 275. Product receiving opening 272 is aligned with portal 187, while product access opening 275 constitutes an exposed portion of dispensing chamber 65 which allows a consumer to retrieve the selected product container 26.

In accordance with the most preferred form of the invention, product holder 250 is provided with a rotatable shield member 290. Shield member 290 includes an upper surface 294 having an extended portion 295 that, as will be discussed more fully below, defines an axis of rotation. Upper surface 294 leads to a lower edge portion 296 through a wall member 298 having first and second outer edge sections 305 and 306 that define an opening 315. Preferably, shield member 290 is formed from a clear plastic material that is resistant to breaking, such as, for example, polycarbonate or plexi-glass. Shield member 290 is operatively connected to a motor 336 mounted to a motor base 338 on top section 263 of product holder 250. Motor 336 is operatively connected to extended portion 295 and, when activated, rotates shield member 290 such that wall member 298 shifts between a first or product receiving position as indicated in FIG. 6, wherein product receiving opening 272 is exposed to portal 187, to a second or product dispensing position as represented in FIG. 7, wherein wall member 298 is rotated so as to block product receiving opening 272 while, simultaneously, exposing product access opening 275 to opening 315 in shield member 290 to allow the consumer to retrieve the vended product. At this point, it is important to note that, when in the product dispensing position of FIG. 7, shield member 290 prevents unauthorized access to product storage and display zone 14 through portal 187. That is, without the presence of shield member 290, an individual may be able to reach into product holder 250, pivot door 200 away from magnets 220 and 221, and pilfer products from product storage and display zone 14. However, rotation of shield member 290 prevents this access, as well as preventing an individual from positioning a body part in dispensing chamber 14 as container 26 is being discharged therein. In the most preferred embodiment of the invention, an overall degree of rotation in each direction is defined or limited by a pair of stops, one of which is indicated at 343. As shown, stop 343 is preferably integrally formed in second wall portion 267.

In further accordance with the most preferred form of the invention, base section 260 of product holder 250 includes a product support surface 363. A sensor 366, similar to that described above with respect to product delivery cup 114, is provided below product support surface 363 to sense the presence of the selected product container 26 in product holder 250. In the most preferred form of the invention, sensors 171 and 366 are constituted by capacitive sensors, however, it should be noted that various other forms of sensors, such as, for example, infrared, ultrasonic, contact or pressure sensors, can also be employed. In any case, sensor 366, upon sensing the presence of the selected product container 26, signals vending machine 2 to activate motor 336 in order to shift shield member 290 between the product receiving and product dispensing positions. Also, sensor 366 preferably signals activation of a light 370 provided in base section 260 to illuminate product holder 250 for the consumer. Preferably, light 370 is constituted by a light emitting diode array, however, other forms of lights can also be employed. In addition, light 370 could be readily mounted at other locations, such as from motor base 338.

At this point, it should be understood that the product discharge and delivery system of the present invention provides a simple and effective mechanism for delivering a selected product to a consumer. More specifically, the present invention ensures that the product is delivered to a consumer, while also preventing unauthorized access to vending machine 2. In the event a product container is not discharged into product holder 250, such as if a particular product queue was empty, vending machine 2 would receive a mis-vend signal through sensor 366, and a refund of the purchase amount would be available to the consumer. That is, if sensor 366 does not sense the presence of a product container 26 after sensor 132 signals release of the product container from product delivery cup 114, vending machine 2 will make available options to either select another product or obtain a refund of the purchase price.

Although described with reference to a preferred embodiment of the invention, it should be readily understood that various changes and/or modifications can be made to the invention without departing from the spirit thereof. For instance, it should also be noted that various mechanisms could be employed to carry the selected product towards the delivery chamber. In addition, the shape, drive and operation of the product delivery cup and overall product transport system could readily be varied. In general, the invention is only intended to be limited by the scope of the following claims.

We claim:

1. A vending machine comprising:

a cabinet;

a product storage zone arranged within the cabinet;

a product support shelf positioned in the product storage zone;

at least two dividers extending across the at least one product support shelf and establishing a product queue;

a release mechanism mounted at a front end portion of the product queue;

a dispensing chamber mounted in the cabinet;

a product transport system for carrying a selected product from the product support shelf towards the dispensing chamber, at least a portion of said product transport system being selectively shiftable between a product receiving position and a delivery position, said product transport system including a product delivery cup having a carriage portion and a shroud portion pivotally mounted to the carriage portion, said shroud portion including a discharge element and open bottom section;

a portal operatively connecting the product storage zone and the dispensing chamber, said portal including a discharge member;

a door pivotally mounted across the portal, said discharge element engaging the discharge member to pivot the shroud and the door in order to release a selected product from the product delivery cup through the portal for delivery into the dispensing chamber; and a product holder mounted in the dispensing chamber, said product holder including a shield member, said shield member being rotatable between a product receiving position, wherein the product holder is open to the portal for receiving a selected product while access to the dispensing chamber is blocked by the shield member, and a product delivery position, wherein the shield member blocks access to the portal through the product holder while the product holder is exposed allowing a consumer to retrieve the selected product.

2. A vending machine comprising:

a cabinet;

a product storage zone arranged within the cabinet;

at least one product support shelf positioned in the product storage zone;

at least two dividers extending across the at least one product support shelf and establishing a product queue;

a release mechanism mounted at a front end portion of the product queue;

a dispensing chamber mounted in the cabinet;

a product transport system for carrying a selected product from the at least one product support shelf towards the dispensing chamber, at least a portion of said product transport system being selectively shiftable between a product receiving position and a delivery position, said product transport system including a product delivery cup having a carriage portion and a shroud portion pivotally mounted to the carriage portion, said shroud portion including a discharge element and an open bottom section;

a portal operatively connecting the product storage zone and the dispensing chamber, said portal including a discharge member; and a door pivotally mounted across the portal, said discharge element engaging the discharge member to pivot the shroud and the door in order to release a selected product from the product delivery cup through the portal for delivery into the dispensing chamber.

3. The vending machine according to claim 2, further comprising:

a frame including top, bottom and opposing side frame members that extends about the portal, said door being pivotally supported by the frame.

4. The vending machine according to claim 3, wherein the discharge member is constituted by the top frame member, said discharge member extending from a first side of the portal to a second side of the portal and fixedly spaced from said portal by a pair of offsets.

5. The vending machine according to claim 3, wherein the frame includes at least one magnet for retaining the door in a closed position.

6. The vending machine according to claim 2, further comprising:

a sensor for sensing a presence of a product container in the product delivery cup.

7. The vending machine according to claim 6, further comprising:

a light for the product delivery cup, said light being illuminated based upon a signal from the sensor indicating the presence of a product in the product delivery cup.

8. A vending machine comprising:

a cabinet;

a product storage zone arranged within the cabinet;

a product support shelf positioned in the product storage zone;

at least two dividers extending across the at least one product support shelf and establishing a product queue;

a release mechanism mounted at a front end portion of the product queue;

a dispensing chamber mounted in the cabinet;

a portal operatively connecting the product storage zone and the dispensing chamber, said portal including a discharge member; and a product holder mounted in the dispensing chamber, said product holder including a shield member, said shield member being rotatable about a substantially vertical axis between a product receiving position, wherein the product holder is open to the portal for receiving a selected product while access to the dispensing chamber is blocked by the shield member, and a product delivery position, wherein the shield member blocks access to the portal through the product holder while the product holder is exposed allowing a consumer to retrieve the selected product.

9. The vending machine according to claim 8, wherein the product holder includes a base section, a top section, a first wall section and a second wall section.

10. The vending machine according to claim 9, further comprising:

a sensor located in the base section of the product holder, said sensor being adapted to sense a presence of a product container in the dispensing chamber.

11. The vending machine according to claim 10, wherein the sensor is constituted by a capacitive sensor.

12. The vending machine according to claim 11, further comprising:

a light mounted to the product holder, said light being illuminated based upon a signal from the sensor indicating the presence of a product in the dispensing chamber.

13. The vending machine according to claim 9, further comprising:

at lease one stop member for limiting rotational travel of the shield member.

14. The vending machine according to claim 13, herein the at least one stop member is integrally formed in one of the first and second wall sections.

15. The vending machine according to claim 9, wherein the shield member includes a top wall and a side wall, said top wall having an extended portion that defines an axis of rotation for the shield member.

16. The vending machine according to claim 15, further comprising:

a motor mounted to the top section of the product holder and operatively connected to the extended portion of the shield member, said motor being selectively operated to rotate the shield member between the product receiving and product delivery positions.

17. A method of discharging a selected product from a product shelf of a vending machine during a vend operation comprising:

transporting a product delivery cup, including a carrier portion, a shroud portion pivotally mounted to the carrier portion, a discharge element connected to the shroud portion and an open bottom section, to a product receiving position;

releasing the selected product from a product queue on the product shelf into the product delivery cup;

shifting the product delivery cup from the product receiving position towards a dispensing position;

engaging the discharge element with a discharge member mounted in the vending machine to cause pivoting of the shroud portion relative to the carrier portion of the product delivery cup;

releasing the selected product through the open bottom section of the product delivery cup into a portal that leads to a dispensing chamber having a product holder; and rotating about a substantially vertical axis a shield member located in the product holder from a product receiving position, wherein the shield member blocks access to the dispensing chamber while exposing the product holder to the portal, to a product delivery position, wherein the shield member blocks access to the portal through the dispensing chamber while providing access to the product holder allowing a consumer to retrieve the selected product.

18. The method of claim 17, further comprising:

sensing a presence of a product in the product delivery cup; and illuminating the product delivery cup if a product is sensed.

19. The method of claim 17, further comprising:

sensing a presence of a product in the product holder; and illuminating the product holder if a product is sensed.

20. The method of claim 17, further comprising: automatically returning the shield member to the product receiving position after the product is removed from the dispensing chamber.

* * * * *